US006367660B1

(12) United States Patent
Chang

(10) Patent No.: US 6,367,660 B1
(45) Date of Patent: Apr. 9, 2002

(54) SAFETY DEVICE FOR A DOUBLE VALVE ARRANGEMENT FOR BEER KEG

(76) Inventor: Kung-chien Chang, 9031 E. Slauson Ave., Pico Rivera, CA (US) 90660

( * ) Notice: Subject to any disclaimer, the term of this patent is extended or adjusted under 35 U.S.C. 154(b) by 0 days.

(21) Appl. No.: 09/957,378

(22) Filed: Sep. 20, 2001

(51) Int. Cl.[7] ..... B67B 5/00

(52) U.S. Cl. ..... 222/153.09; 222/400.7; 222/509; 222/399; 137/212; 137/322

(58) Field of Search ..... 222/153.09, 153.03, 222/399, 400.7, 400.8, 509; 137/212, 322

(56) References Cited

U.S. PATENT DOCUMENTS

| | | | | | |
|---|---|---|---|---|---|
| 4,150,771 | A | * | 4/1979 | Golding | 222/400.7 |
| 4,363,336 | A | * | 12/1982 | Cerrato | 137/212 |
| 4,406,301 | A | * | 9/1983 | Cerrato | 137/212 |
| 4,458,833 | A | * | 7/1984 | Bailey | 222/400.7 |
| 4,488,572 | A | * | 12/1984 | Brown et al. | 137/315 |
| 5,203,477 | A | * | 4/1993 | Lo | 222/153 |
| 5,242,092 | A | * | 9/1993 | Riis et al. | 222/400.7 |
| 5,526,965 | A | * | 6/1996 | Degenkolbe et al. | 222/400.7 |
| 5,653,253 | A | * | 8/1997 | Larsen | 137/315 |
| 5,713,496 | A | * | 2/1998 | Ipsen | 222/400.7 |
| 5,833,098 | A | * | 11/1998 | Gomi | 222/400.7 |
| 6,089,415 | A | * | 7/2000 | Terpstra et al. | 222/397 |

FOREIGN PATENT DOCUMENTS

| | | | | |
|---|---|---|---|---|
| DE | 4114604 | A1 * | 11/1992 | B67D/1/08 |
| GB | 2188040 | A * | 9/1987 | B67D/1/14 |
| GB | 2188040 | | 9/1987 | |
| GB | 0623550 | A2 * | 11/1994 | B67D/1/04 |
| GB | 0645342 | A1 * | 3/1995 | B67D/1/08 |

* cited by examiner

*Primary Examiner*—Henry C. Yuen
*Assistant Examiner*—Frederick Nicolas

(57) ABSTRACT

A safety device for a double valve arrangement for beer keg comprises a housing and a down pipe. A liquid valve and a gas valve are formed in the housing. A locking member is disposed between the down pipe and the housing, with two flaps protruding out of the housing to prevent the propping out of the valve arrangement from the beer keg when it is not intended. An inward bending connected to the locking member is in contact with a lower portion of the down pipe. When a special tap is engaged to push down a valve ring and the down pipe, the direction of the inward bending changes outwardly, which results in a changed position of the locking member, retrieving the flaps to the inside of the housing, making it possible to detach the double valve arrangement out of the beer keg.

10 Claims, 6 Drawing Sheets

4
5

6
6a

7

18
16
17

9
15
8

SAFETY DEVICE FOR A DOUBLE VALVE ARRANGEMENT FOR BEER KEG

FIELD OF INVENTION

This invention relates to a double valve arrangement used for a pressurized beer keg, said arrangement comprises a safety device in order to prevent a valve body popped out of the keg under pressure causing unintended personal injury, or when the dismount is handled by somebody who is unauthorized to do so.

In public places like restaurants or pubs where beer is served, kegs are commonly used. The keg is highly pressurized with carbon dioxide gas inside. When serving beer out of the keg into a drinking glass, more carbon dioxide gas is pressed into the keg through a gas valve, making it possible to dispense the beer out through a liquid valve. Thus, a double valve arrangement, installed in the insect part of the keg, serves dual purposes, one for gas passage, and the other for liquid passage. When the keg is empty, it is returned to a beverage manufacturer for recycling and refill. The keg has to be cleaned prior to the procedure of refilling it with beer. When a worker detaches the valve arrangement away from the keg for cleaning purpose, it is often difficult for him to know whether there remains any of the gas pressure within the keg. The valve body, when being dismounted from the keg, could pop out suddenly due to the possible gas pressure that remains within the container, causing serious personal injury to the one who bends working on it. In addition, when the keg is handled by somebody who is either unauthorized to do so, or ignorant of the potential danger, same serious result could also ensure.

Several designs and ideas have been proposed with an intent to solve this particular problem. According to a UK patent (2,188,040), a valve body is formed with a projection having radical extent and axial location that the valve body can be moved down through the keg neck ring when separate from the valve housing. But the valve housing and the valve body can be coupled together only after the valve body with its projection has been moved down through the neck ring. Since the device cannot be inserted into the keg dispensing aperture in a fully assembled condition, it is often considered inconvenient and time-consuming for operation and handling.

Another U.S. Pat. No. (5,653,253), comprises a catch with a vertically, downwardly converging wedge, the edge of which protrudes through the housing window to prevent the passage of the valve through the opening of the neck ring. However, in addition to a spanner to dismantle the valve body, there must also be a de-activation rod in order to fully pull the valve body out. Thus it is not convenient to handle the dismount procedure in solving the problem.

A recent U.S. Pat. No. (5,833,098) has been proposed with an idea of a stopper to prevent the propping out of the spear tube by hooking the stopper portion to the keg neck interface. But it is only possible to completely detach the spear tube from the beer keg with the aid of both a tool and a jig, in that the tool is rotated on the axial center of the spear tube and the jig is employed to pull the stopper portion into an inside of the body before a complete detachment can possibly be achieved.

These conventional designs, as well as some others, while attempting to serve the purpose of the prevention of the valve body propping out of the beer keg, are inconvenient to operate in practice, and are also complicated in design.

BRIEF SUMMARY OF THE INVENTION

It is an object of the present invention to provide an improved double valve arrangement to prevent the propping out of the valve body either unintended or unauthorized, by means of a simple safety device that avoids disadvantages of inconvenience and complicated designs.

The safety device, under the present invention, can be inserted into the beer keg dispensing aperture as a wholly assembled piece by being pushed down into it axially and screwed tight, and it can be pulled out as a whole piece by a special tap.

According to the present invention, a double valve body is formed with a locking member disposed between a down pipe and a housing. Extended from the locking member there are two bendings in opposite directions, one of which inwardly in contact with the down pipe, and the other outwardly secured to the housing. The flaps of the locking member normally protrude out to prevent the detachment of the valve body out of the beer keg neck ring. When a special tap is employed to push against the double valve body, the down pipe moves downward, and the direction of the inward bending of the locking member changes accordingly, along from a lower portion of the down pipe to an enlarged portion of the down pipe, which results in the movement of the locking member, retrieving the flaps to the inside of the housing in order that the valve body could be moved out without any difficulty. The special tap is only available to the authorized personnel at the manufacturers.

DETAILED DESCRIPTION OF THE INVENTION

Figure 1:
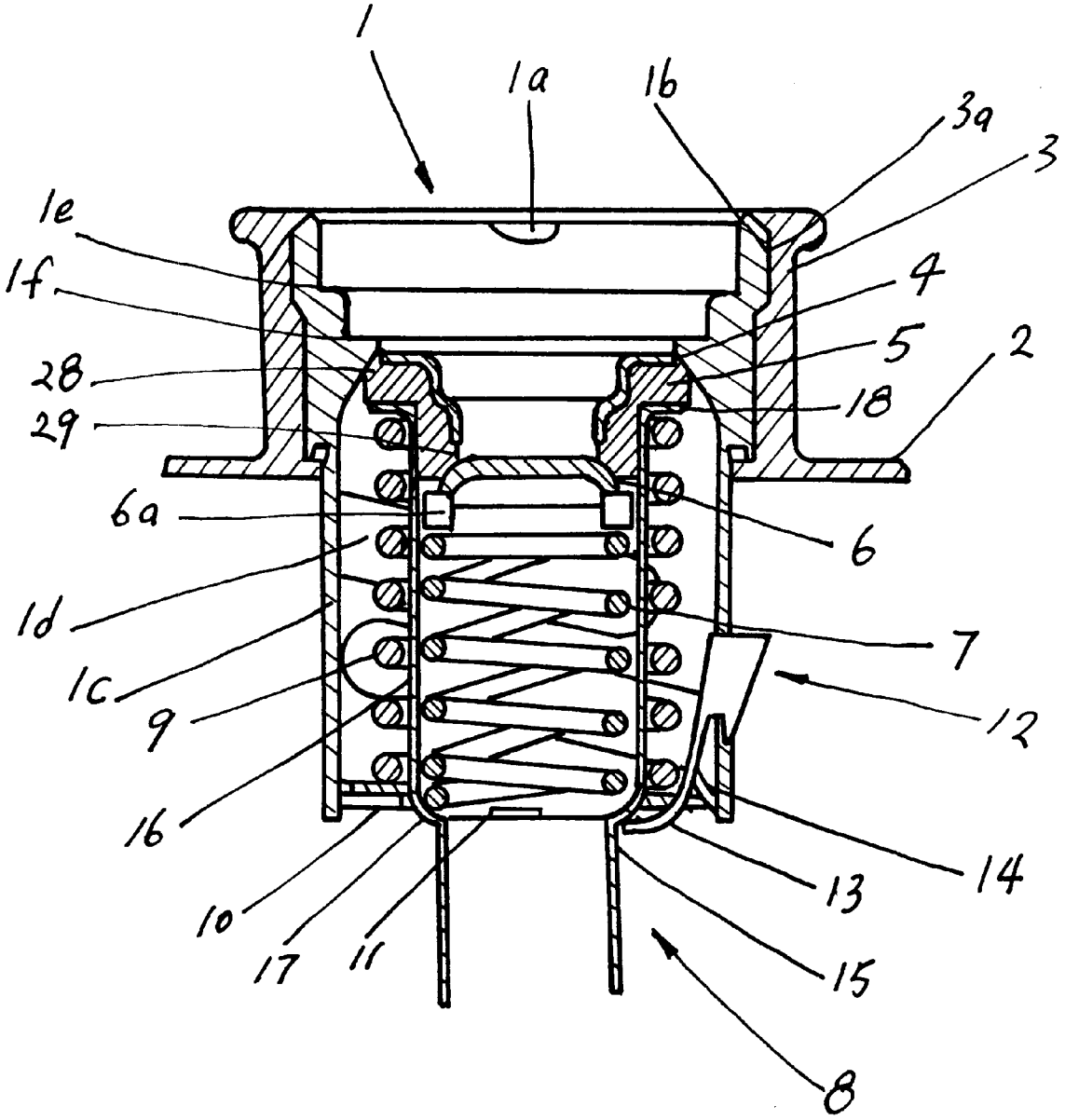
FIG. 1 is a cross sectional view of an essential part of an embodiment of a double valve arrangement according to the invention
Figures 2A, 2B, 2C, 2D, 2E:
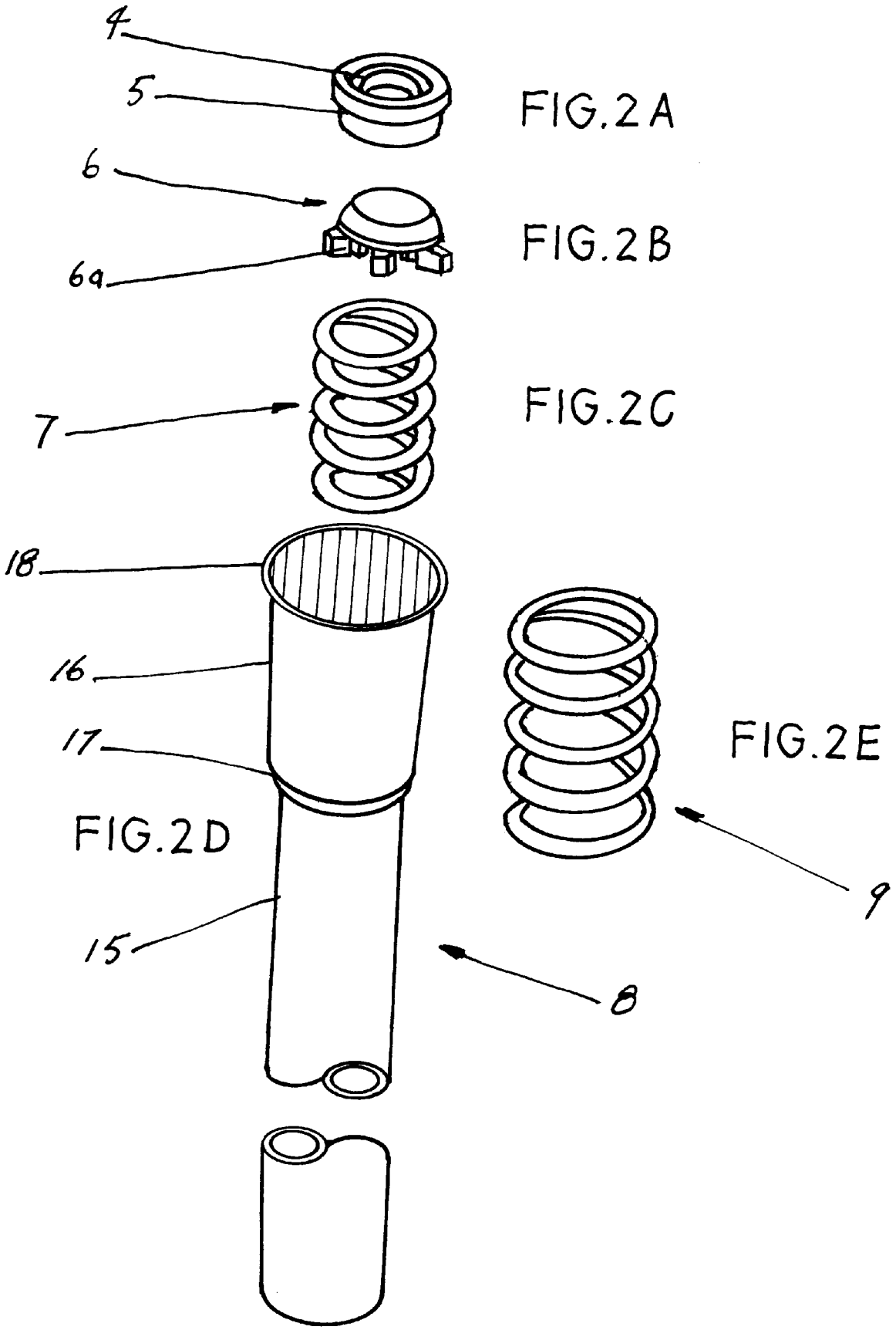
FIG. 2A is a perspective view of a valve ring
FIG. 2B is a perspective view of a valve plug
FIG. 2C is a perspective view of an internal coil spring
FIG. 2D is a perspective view of a down pipe
FIG. 2E is a perspective view of an external coil spring

As shown in FIG. 1, a double valve body 1 is disposed in a neck ring 3 of a beer keg 2. This double valve body 1 comprises a housing 1*c* and a down pipe 8, both arranged in a way by an external coil spring 9 and a base disc 10. The details shall be provided below.

The housing 1*c* is formed in a cylindrical shape. The top portion of the housing 1*c* is disposed in the neck ring 3 of the keg 2. Around the top portion of the housing 1*c* there are external threads 1*b*, and the neck ring 3 is internally threaded 3*a*. Both the external threads 1*b* of the housing 1*c* and the internal threads 3*a* of the neck ring 3 of the keg 2 are compatible in that they accommodate each other when the double valve body 1 is inserted into the neck ring 3 of the keg 2. When the housing 1*c* is inserted into the neck ring 3 of the keg 2, it is necessary to screw it tight by operation of rotation clockwise with a coupling tool (not shown), so that with the accommodation of both the threads 1*b* and the threads 3*a*, the double valve body 1 is secured safely to the keg 2.

Inside the top portion of the housing 1*c* there are two ratchets la formed toward the center axis, with equal and predetermined intervals between them. These two ratchets 1*a* are to serve the purpose of engaging a dispense head for liquid, or the special tap (not shown) for installation and dismantlement.

Below the ratchets 1*a,* the inside cylindrical shape abruptly becomes smaller, forming an inside shoulder portion l*e.* Below this inside shoulder portion 1*e,* the inside cylindrical shape again becomes abruptly smaller, forming an inside collar 1*f* which defines the extent of the housing 1*c* opening.

The down pipe 8, which is installed within the housing 1*c,* is a long tube, extending down to the bottom of the keg 2. The top of the down pipe 8 is formed in a flange portion 18. The flange portion 18 is such that the down pipe 8 can pass through the housing 1*c* by the insider collar 1*f.*

There is an upper portion 16 of the down pipe 8. It is an enlarged one, compared to a lower portion 15 of the down pipe 8 in that the diameter of the upper portion 16 is larger than that of the lower portion 15. Between these two portions there is a shoulder portion 17 of the down pipe 8, where the enlarged portion 16 changes to the lower portion 15.

As shown in FIG. 2A through FIG. 2E, within the upper portion 16 of the down pipe 8, there is an internal coil spring 7, which sits on the shoulder portion 17 of the down pipe 8. Between the flange portion 18 of the down pipe 8 and the underside of the inside collar if of the housing 1*c,* there is a valve ring 4 and a valve plug 6. The valve ring 4, except its surface, is wrapped with elastomer 5. The valve ring 4 with the elastomer 5 as one piece is larger in diameter than the opening of the housing 1*c,* as defined by the inside collar if. This design enables the valve ring 4 to be positioned, supported by the valve plug 6, directly under the inside collar if of the housing 1*c*. The valve plug 6 is a piece of round shape, with its surface smaller than the bottom. It is formed with five square pieces 6*a,* all of the same size and dimension under its bottom for support and stability, with equal and predetermined intervals between these square pieces 6*a*. For support, the valve plug 6 itself is pushed upward by the top of the internal coil spring 7.

Figure 5:
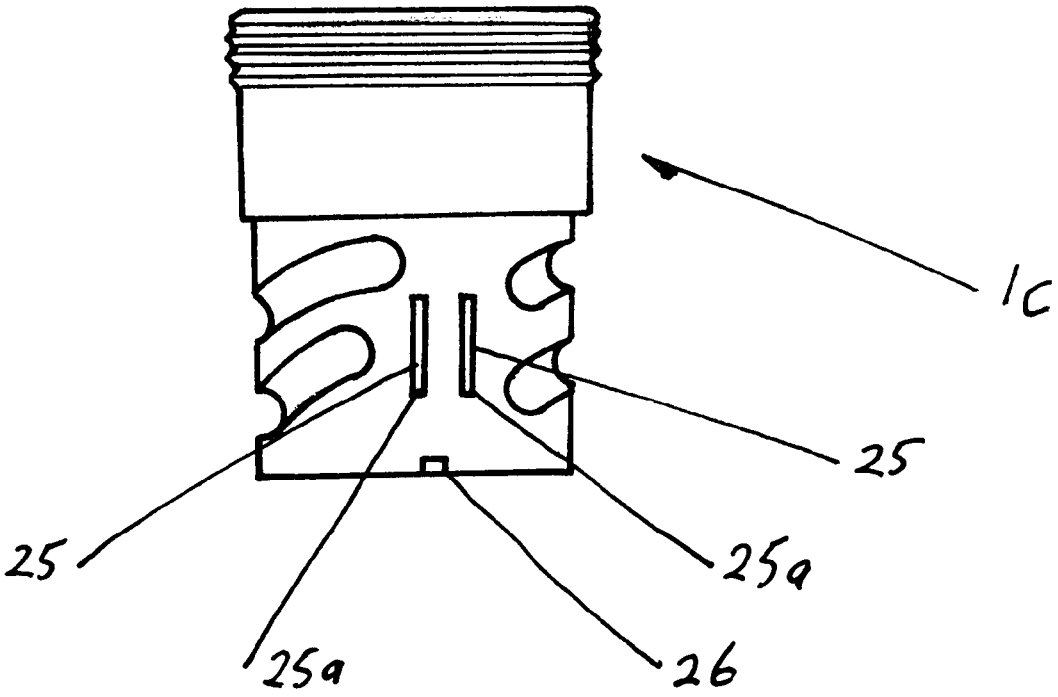
FIG. 5 is a perspective view of a housing
Figure 6:
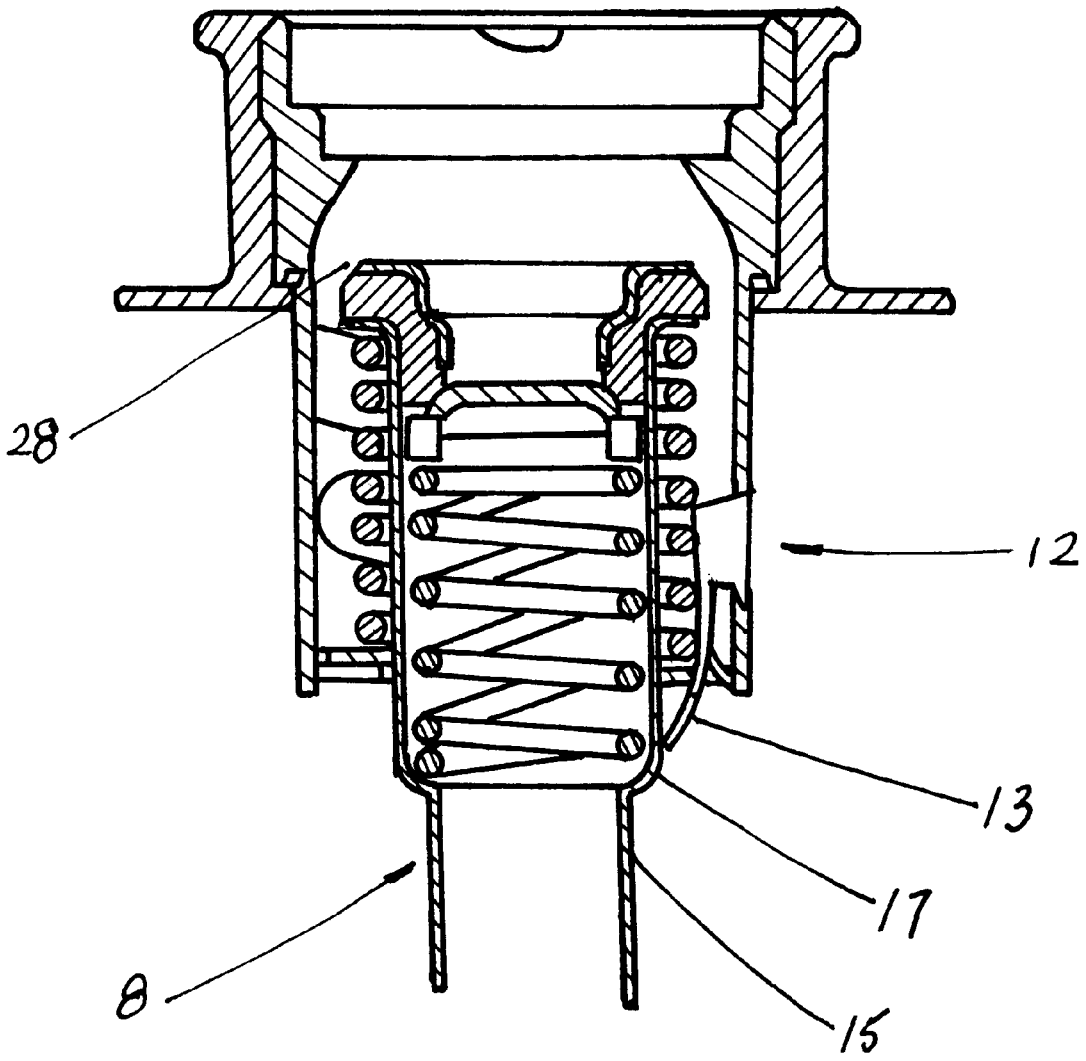
FIG. 6 is a cross sectional view of the embodiment of the double valve arrangement when the locking member is retrieved

As shown in FIG. 5, on the side of the housing 1*c* there are windows 1*d* formed in circumferential direction. On one side between the windows there are two predetermined, rectangular openings 25 formed in a vertical way. These two openings 25 are narrow and parallel to each other. The low ends of the openings 25 are formed in grooves 25*a*. At the bottom portion of the housing 1*c* there is a predetermined incision 26, positioned in the center below the two openings 25.

Inside the wall of the housing 1*c* at the bottom, there are three bayonet pieces 11 formed toward the center axis of the housing 1*c,* with equal intervals among them.

Figure 3:
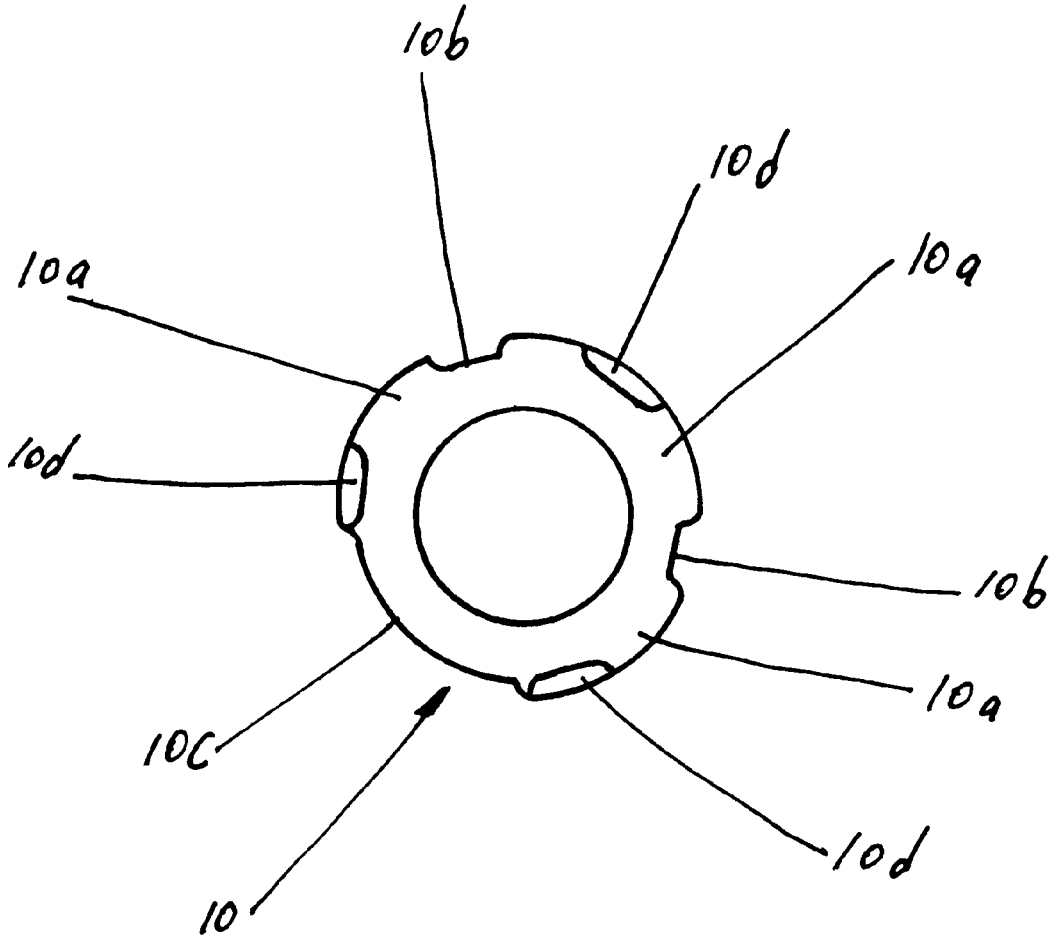
FIG. 3 is a top view of a base disc

As shown in FIG. 1 and FIG. 3, there is a base disc 10 in the housing 1*c* to support the external coil spring 9. The base disc 10 is in a ring shape, the inside circular size of which allows the passage of the down pipe 8, except the flange portion 18 at the top. Along the outside circular shape of the base disc 10 there are three recesses 10*b* and 10*c*. Two of these recesses 10*b* are of the same size. The third recess is an extended one 10*c*. Along the outside circular shape of the base disc 10 there are three grooves 10*d* which fittingly match the size of the bayonet pieces 11 formed inside the wall of the housing 1*c* at the bottom.

There are three flanges 10*a* formed between the recesses 10*b* and 10*c*. These flanges 10*a* form an irregular outside circular shape of the base disc 10 in that the two recesses 10*b* and the extended recess 10*c* are different in size. As a result, there are unequal intervals between these three recesses. The outside circular shape of the base disc 10 is formed such that it is possible to place the base disc 10 in the housing 1*c*.

Figure 4A:
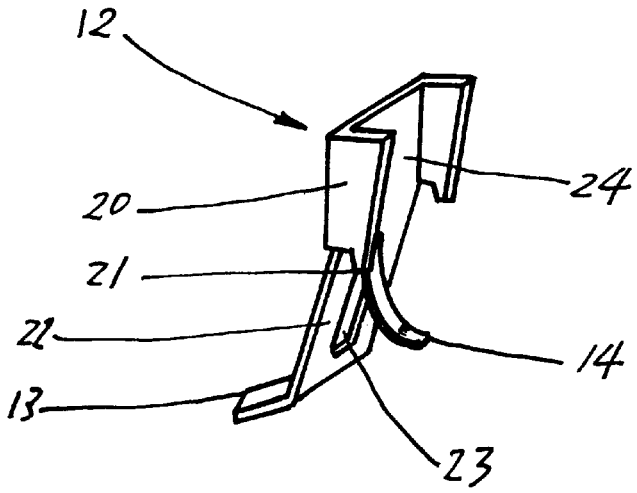
FIG. 4A is a front perspective view of a locking member
Figure 4B:
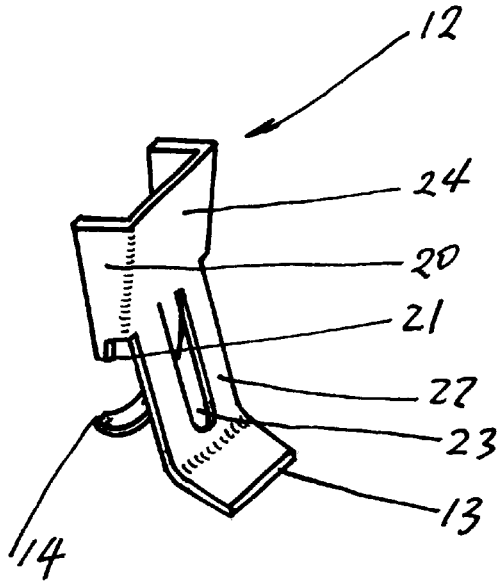
FIG. 4B is a back perspective view of the locking member

As shown in FIG. 1, FIG. 4A and FIG. 4B, there is a locking member 12 disposed between the external coil spring 9 and the inside wall of the housing 1*c*. The main part of the locking member 12 is a body piece 24. On each side of the body piece 24 is a flap 20. The body piece 24 and the two flaps 20 are formed in a 90 degree shape. The low end portion of each flap 20 is formed in a hook 21 so that there is a hook 21 on each side of the body piece 24. The upper portion of the flaps 20 is bigger than the lower portion of the flaps 20. The distance between the top and bottom of the flaps 20 enables the flaps 20 to be readily inserted into the two openings 25 of the housing 1*c* outwardly. When the flaps 20 are thus inserted, the hooks 21 are secured into the grooves 25*a* at the bottom of the openings 25. When the hooks 21 are positioned in this way, the upper portions of the flaps 20 are in a free position as the flaps 20 can protrude out of the housing 1*c* to serve a locking purpose, or they can also be retrieved inside the wall of the housing 1*c,* depending upon the different positions of the body piece 24 of the locking member 12.

Below the body piece 24, there is a projection 22 tilting inside. An inward bending 13 is formed at the end of the projection 22. The direction of the projection 22 and the inward bending 13 is opposite to that of the flaps 20.

Another bending 14 is formed in the middle of the projection 22. This bending 14 extends outwardly and is smaller in size than the inward bending 13 in that the projection 22 is larger than the outward bending 14. The direction of the outward bending 14 is opposite to that of the inward bending 13, but is the game as that of the flaps 20. The formation of the outward bending 14 leaves an opening cut 23 in the projection 22. This opening cut 23 in the projection 22 is the same in size as the outward bending 14, and does not extend to the inward bending 13. Thus, the whole locking member 12 is formed from one piece. In a variation, the locking member 12 can also be formed from two pieces.

Since the inward bending 13 and the outward bending 14 extend in opposite directions, there is an elastic force with each of them when the locking member 12 is fully disposed in a proper position. The outward bending 14 is formed in a way that when two hooks 21 are secured in the grooves 25*a* of the openings 25 of the housing 1*c,* the tip of the outward bending 14 is settled in the area left by the incision 26 of the housing 1*c*. When the inward bending 13 and the outward bending 14, with the respective elastic force of each, work in the opposite directions, the body piece 24 of the locking member 12 is pressed against the inside wall of the housing 1*c*.

In the double valve arrangement, the valve for liquid passage is formed between the valve plug 6 and the valve ring 4 with elastomer 5. This liquid valve is closed in that the internal coil spring 7 disposed in the upper portion 16 of the down pipe 8 always pushes upward against the valve plug 6. With the support of five square pieces 6*a,* the valve plug 6 is secured between the internal coil spring 7 and the valve ring 4 wrapped with the elastomer 5.

The second valve designed for gas passage is formed between the inside collar if of the housing 1*c* and the valve ring 4 wrapped with the elastomer 5. The external coil spring 9 disposed between the down pipe 8 and the housing 1*c* pushes upward under the flange portion 18 of the down pipe 8. The gas valve is closed under the force of the external coil spring 9 unless the valve ring 4 is pushed down by a force outside, like a dispense head or a tap.

For the base disc 10, the inside circular shape of the base disc 10 allows the down pipe 8, both the upper portion 16 and the lower portion 15, to pass through until the flange portion 18. To properly assemble the down pipe 8 and the base disc 10 in the housing 1*c*, place the lower portion 15 of the down pipe 8 through the base disc 10 with the upper portion 16 of the down pipe 8 in the housing 1*c*. When the base disc 10 is installed, it can only come into the housing 1*c* when the three recesses 10*b* and 10*c* aim at the bayonet pieces 11 of the housing 1*c*, as the recesses 10*b* and 10*c* give room for the bayonet pieces 11. After the base disc 10 comes past the bayonet pieces 11, it is both possible and necessary to rotate the base disc 10 to the right so that the bayonet pieces 11 are properly placed in the grooves 10*d* of the base disc 10, with the extended recess 10*c* positioned where the incision 26 and the two openings 25 of the housing 1*c* are located. The base disc 10 disposed in this way supports the external coil spring 9 from below. The external coil spring 9 pushes upward under the flange portion 18 of the down pipe 8.

When the double valve body 1 is fully installed, both the liquid valve and the gas valve are closed in that the internal coil spring 7 pushes upward against the valve plug 6 which is in contact with the valve ring 4, and the external coil spring 9 pushes under the flange portion 18 of the down pipe 8 and the top of the flange portion 18 is in contact with the valve ring 4 wrapped with the elastomer 5.

When a dispense head (not shown), engaged to the beer keg dispensing aperture, is being pushed down, the liquid valve and the gas valve are pushed down and opened by a pressuring portion of the dispense head. This enables the carbon dioxide gas supplies from a gas cylinder connected to the dispense head to be flown into the beer keg 2 through gas passage 28 between the valve ring 4 and the inside collar 1*f* of the housing 1*c*. When the pressure in the beer keg 2 is built up to a certain point, the beer in the keg 2 is flown under high pressure to the dispense head from the down pipe 8 through liquid passage 29 between the valve plug 6 and the valve ring 4 before being flown from the dispense head to a drinking cup for desired beverage service.

In order to install the locking member 12 properly between the inside wall of the housing 1*c* and the external coil spring 9, it is necessary to insert the flaps 20 of the locking member 12 into the two openings 25 of the housing 1*c* so that the two hooks 21 are secured in the grooves 25*a* of the openings 25 of the housing 1*c*, and the tip of the outward bending 14 is fittingly placed in the position of the incision 26. As a result, the body piece 24 leans against the inside wall of the housing 1*c*. When the locking member 12 is arranged in this way, the inward bending 13 is posed toward the down pipe 8 as it is in an opposite direction.

When the double valve body 1 is fully installed, the end of the inward bending 13 of the locking member 12 is in contact with the lower portion 15 of the down pipe 8. The locking member 12 is disposed between the external coil spring 9 and the inside wall of the housing 1*c*, with the hooks 21 secured in the grooves 25*a* of the opening 25 and the tip of the outward bending 14 settled in the position of the incision 26. Under the elastic force of the inward bending 13 and the projection 22, the upper part of the flaps 20 protrudes outside the wall of the housing 1*c*, serving to prevent the valve body from being pulled upward out of the neck ring 3 of the keg 2 by a person not authorized to do so, as the protruding part of the flaps 20 works against the under surface of the beer keg 2. As a result, if anyone tries to detach the valve body away from the neck ring 3 of the keg 2 by having the valve body unscrewed and loosened, he has to be authorized with a special tap (not shown) to achieve his purpose. With the advantage of this safety devise, the valve body 1 in the fully assembled state could only be pulled upward out of the neck ring 3 of the keg 2 by an authorized person with the aid of the special tap.

In order to properly detach the double valve body 1 away from the keg 2, it is necessary to employ the special tap. The tap is first inserted into the top portion of the double valve body 1 above the inside collar if and is engaged to the ratchets la by operation of rotation. When the tap is further pushed down, the valve ring 4 is also pushed down, creating a clearance for gas passage 28 between the valve ring 4 wrapped with the elastomer part 5 and the inside collar if of the housing 1*c*. As a result, the remains of the gas in the beer keg 2 is reduced and finally released. However, even if the gas pressure within the keg 2 is reduced or released, the double valve body 1 can not be completely detached away from the keg 2 due to the work of the locking member 12 with the upper portion of the flaps 20 protruding out of the housing 1*c* unless the tap is further pushed down. When the tap is further pushed down, the down pipe 8, against force of the external coil spring 9, is pushed down accordingly. When the down pipe 8 moves down, the contact position of the lower portion 15 with the end of the inward bending 13 of the locking member 12 changes to a new position of the upper portion 16. When this happens, the direction of the inward bending 13 moves both downwardly and outwardly, which results in a changed position of the projection 22 of the locking member 12, retrieving the protruding flaps 20 to the inside wall of the housing 1*c*, making it possible for the authorized person to pull the double valve body 1 upward out of the beer keg as a whole piece.

Thus the safety device of the invention provides a highly reliable, yet simplified means to protect the double valve body 1 from any unauthorized persons, causing unintended injury or damage.

While the above description contains many specifications, those should not be construed as limitations on the scope of the invention, but rather as an exemplification of one preferred embodiment thereof. Many other variations are possible. For example, the projection 22 of the locking member 12 can be extended in accordance with the changed position of the shoulder portion 17 of the down pipe 18 to achieve a new result for the safety purpose.

Accordingly, the spirit and scope of the invention should be determined not by the embodiment(s) illustrated, but by the appended claims and their legal equivalents.

REFERENCE NUMBER

1. double valve body
1*a*. ratchet
1*b*. external thread of the valve body
1*c*. housing
1*d*. housing window
1*e*. inside shoulder portion
1*f*. inside collar
2. beer keg
3. neck ring of the beer keg
3*a*. internal thread of the neck ring
4. valve ring
5. elastomer of the valve ring

6. valve plug
6*a*. valve plug support
7. internal coil spring
8. down pipe
9. external coil spring
10. base disc
10*a*. flange
10*b*. recess
10*c*. extended recess
10*d*. groove
11. bayonet pieces of the housing
12. locking member
13. inward bending of the locking member
14. outward bending of the lock member
15. lower portion of the down pipe
16. upper portion of the down pipe
17. shoulder portion of the down pipe
18. flange portion of the down pipe
20. flap
21. hook
22. projection
23. opening cut
24. body piece
25. opening
25*a*. groove
26. incision
28. gas passage
29. liquid passage

What is claimed is:

1. A safety device for a double valve arrangement for a beer keg comprising:

a double valve body mounted in a neck ring of a beer keg, said double valve body having a cylindrical-shaped housing, a down pipe having a flange portion on top in contact with a valve ring, and a lower portion extending down through said housing, a gas valve formed between an inside collar of said housing and said valve ring, a liquid valve formed between said valve ring and a valve plug supported by an internal coil spring in said down pipe, an external coil spring disposed between said housing and said down pipe, said external coil spring supports the underside of said flange portion of said down pipe, a disc disposed in said housing, said disc supports said external coil spring, a locking member disposed between said housing and said down pipe, said locking member has two flaps, each with a hook on a low end, said hooks are secured on two parallel openings formed on a wall of said housing, said locking member has an outward bending settled on an incision of said housing, and an inward bending in contact with said lower portion of said down pipe, said locking member arranged such that said flaps protrude out of said housing through said openings, whereby said locking member provides a safety means to prevent said double valve body from being propped out of said beer keg.

2. The safety device of claim 1 wherein said housing has circumferential windows on a wall, said housing has an externally threaded top portion to accommodate said neck ring which is internally threaded.

3. The safety device of claim 1 wherein said openings on said wall of said housing are rectangularly and vertically predetermined, each having a groove on a peripheral bottom for said hooks of said locking member.

4. The safety device of claim 1 wherein said incision is formed on one side of the bottom of said housing, positioned in center below said openings for said outward bending of said locking member.

5. The safety device of claim 1 wherein said valve ring is wrapped with a elastomer part to accommodate said valve plug.

6. The safety device of claim 1 wherein said valve plug rests on five square pieces of same dimension, said square pieces are in contact with said internal coil spring disposed in said down pipe.

7. The safety device of claim 1 wherein said down pipe, below said flange portion, has an upper portion which is larger than said lower portion in diameter, there is a shoulder portion between said upper portion and said lower portion, and said shoulder portion is built such that said internal coil spring is disposed in said upper portion of said down pipe.

8. The safety device of claim 1 wherein said locking member has a body piece with said flaps on both side, below said body piece is a projection from a middle of which said outward bending is formed, leaving an opening cut on said projection, said outside bending has a tip on end, said tip is settled on said incision of said housing, said inward bending is built at an end of said projection, said inward bending has an end in contact with said lower portion of said down pipe when said safety device is in a fully assembled state, these two bendings reach in opposite directions.

9. The safety device of claim 1 wherein said base disc is formed in a ring shape, having three flanges and three grooves on its outside circle, said grooves match three bayonet pieces of said housing at a bottom when said safety device is in a fully assembled state, between flanges there are three recesses, one of which is extended, said recesses accommodate said bayonet pieces of said housing.

10. The safety device of claim 1 wherein said locking member with said flaps protrudes out of a wall of said housing against the underside of said beer keg, that when said double valve body and said down pipe are pushed down, said inward bending in contact with said down pipe moves accordingly along from said lower portion to said upper portion, resulting in a changed direction of said locking member, retrieving said flaps within the wall of said housing.

* * * * *